US007156778B1

(12) United States Patent
Blough

(10) Patent No.: US 7,156,778 B1
(45) Date of Patent: Jan. 2, 2007

(54) MOTOCROSS EXERCISER

(76) Inventor: Chad Blough, 1645 Calle Del Oro, Corona, CA (US) 92882

( * ) Notice: Subject to any disclaimer, the term of this patent is extended or adjusted under 35 U.S.C. 154(b) by 0 days.

(21) Appl. No.: 11/356,730

(22) Filed: Feb. 17, 2006

Related U.S. Application Data

(63) Continuation of application No. 10/638,033, filed on Aug. 8, 2003, now abandoned.

(51) Int. Cl.
*A63B 22/06* (2006.01)

(52) U.S. Cl. ..... 482/57; 482/49; 434/61; 463/37

(58) Field of Classification Search ..... 482/44, 482/46, 49, 57, 62, 118, 114–116, 121, 122, 482/126–128, 135, 138, 148, 908; 601/33, 601/36; 463/7, 30, 31, 36, 37; 434/61
See application file for complete search history.

(56) References Cited

U.S. PATENT DOCUMENTS 3,653,659 A * 4/1972 Zinkin ..... 482/49
4,637,605 A * 1/1987 Ritchie ..... 463/37
4,798,377 A * 1/1989 White ..... 482/49
5,006,072 A * 4/1991 Letovsky et al. ..... 434/61
5,141,478 A * 8/1992 Upper ..... 482/44
5,160,303 A * 11/1992 Smith ..... 482/123
5,240,417 A * 8/1993 Smithson et al. ..... 434/61
5,415,550 A * 5/1995 Aoki et al. ..... 434/61
5,634,871 A * 6/1997 Froelich et al. ..... 482/46
D431,060 S * 9/2000 Wyrick ..... D21/684
6,234,800 B1 * 5/2001 Koyama et al. ..... 434/61
6,251,015 B1 * 6/2001 Caprai ..... 463/36
6,409,596 B1 * 6/2002 Hayashida et al. ..... 434/61
2004/0259059 A1 * 12/2004 Aoki et al. ..... 434/61

* cited by examiner

*Primary Examiner*—Jerome Donnelly
*Assistant Examiner*—Tam Nguyen
(74) *Attorney, Agent, or Firm*—William G. Lane

(57) ABSTRACT

A motocross exerciser having a motocross handlebar assembly with a rotatable throttle grip and brake levers under tension which can be utilized to build up hand and wrist forearm strength. The handlebar assembly mounted on a frame which can be rotated about a vertical axis against torque forces to build up the upper arms, shoulder, upper back and lower back.

10 Claims, 7 Drawing Sheets

MOTOCROSS EXERCISER

This application is a continuation application of U.S. patent application Ser. No. 10,638,033, filed Aug. 8, 2003 now abandoned.

FIELD OF THE INVENTION

The present invention is directed to an exercise apparatus. More particularly, it is directed to an exercise apparatus for motocross riders either in the professional class or amateur class and to mountain-bike riders.

BACKGROUND OF THE INVENTION

Motocross is a very popular and exciting sport requiring not only good athletic abilities but also strength. Motocross riders are normally slim and wiry and have the athletic abilities frequently seen gymnasts. Motocross riding requires not only lower body strength but also upper body strength. Since the front wheel of a motocross bike is frequently riding in a rut or trench, it requires great strength to turn the front wheel to get out of trench or rut. In addition, frequently, the motocross rider is in mud or soft earth. Again, it requires great strength to turn the front wheel to ride or walk the motocross bike out of the mud or soft earth. To accomplish this on a moving bike, it requires not only leg strength, but also requires back strength, shoulder strength, arm strength and hand strength. In addition, because of the rapid change in terrain, a motorcross rider is constantly braking and releasing the brakes, and constantly changing the throttle setting, depending if the bike is descending a hill, going up a hill, or on level ground. Thus, unless the rider has good hand strength, the hands become easily fatigued from just applying the brakes and disengaging the clutch which requires the hand brake and clutch levers on the handlebars be depressed. The motocross rider is constantly twisting or rotating the throttle handle to control the power output of the motocross engine which requires good wrist strength and lower arm strength. Although most exercise equipment is more than satisfactory in building up general upper and lower body strength, it does not duplicate the motions and actions that a motocross rider undergoes during a motocross ride or race. No equipment exists that duplicates the action of twisting the handlebars to the left and right at a relatively high rate of speed while at the same time operating the hand brakes and the throttle which requires hand and wrist motions.

The object of this invention is to provide a piece of exercise equipment which duplicates the motions of a motocross bike in operation to increase the upper body strength, stamina, and quickness of the motocross rider.

SUMMARY OF THE INVENTION

The motocross exerciser comprises a frame having a front housing, a back housing, and top and bottom plates securing the front housing to the back housing in a spaced apart relationship; a handlebar assembly secured to the frame; and a support having a vertical axis and adapted to be supported by a base, the support supporting the frame for rotation about the vertical axis.

The handlebar assembly has handles with a brake lever and clutch lever, and one handle has a rotatable grip emulating a throttle handle. The brake levers are squeezable from an extended brake Off position to a depressed brake On position. The clutch lever is squeezable from an extended clutch engaged position to a depressed clutch disengaged position. The rotatable grip is rotatable from an idle position to a full power position. The brake lever and clutch lever being connected to separate tensioning means by separate cable linkage, the rotatable grip connected to a separate tensioning means by a separate cable linkage. The tensioning means biasing the brake lever to an extended brake Off position, biasing the clutch lever to an extended clutch engaged position, and biasing the rotation of the rotatable grip to the idle position. The support in conjunction with the frame having adjustable friction means for adjusting the force required to rotate the frame about the vertical axis.

Preferably the handlebar assembly is detachably secured to the frame. Preferably the handlebar assembly can be partially rotated along an axis perpendicular to the vertical axis. Preferably each tensioning means comprising a slide detachably secured to one end of the cable linkage, an adjustable stop through which the cable linkage can freely move and a compression spring positioned between the slide and the adjustable stop and biasing the slide away from the adjustable stop. Preferably the slide, stop, and compression spring tensioning means is positioned in a bore in the front housing. Preferably the position of the stop with respect to the slide is adjustable. Preferably, the positioning means includes a threaded tensioning screw having a longitudinal central bore for the passage of the cable, the adjustable screw threadingly engaging the front housing coaxially with the bore and the end of the threaded screw and engaging the stop with the cable passing freely through the central bore of the threaded screw and the stop. Preferably the torque means comprises a first plate secured to the top of the support and positioned against a portion of the bottom plate of the frame, a shaft freely extending through the back housing and the top and bottom plates and secured to the support, the top of the shaft receiving a handle with a sleeve in thread relationship, the handle threadingly moveable up and down the top portion of the shaft, a compression spring, receiving the shaft, positioned between the top of the back housing and the sleeve, the compression spring biasing the frame against the first plate and away from the sleeve. Preferably the support is slidingly received by the base. Preferably the support can be detachably secured in the base. Preferably the base has a hollow pillar that receives the support within the pillar for slidable engagement.

DETAILED DESCRIPTION OF THE INVENTION

Figure 1:
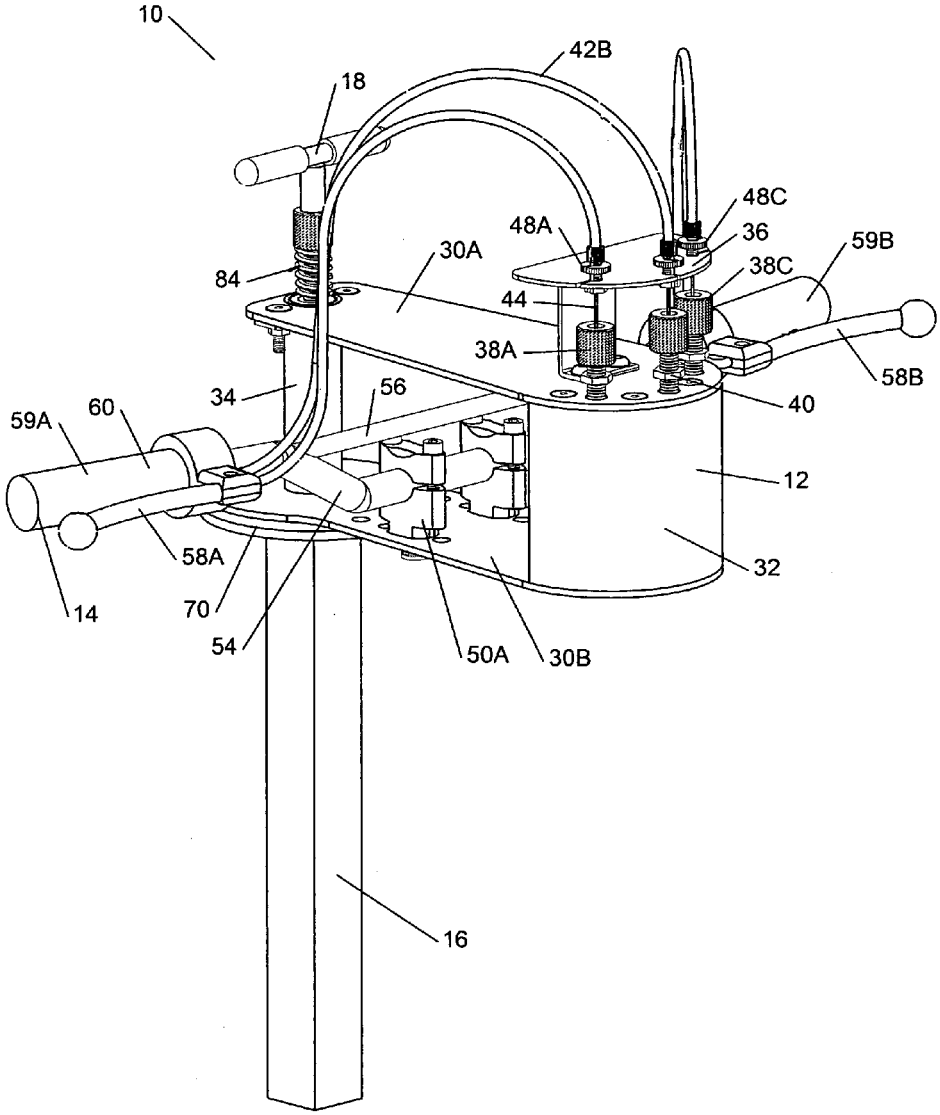
FIG. 1 is a top left front perspective view of the motocross exerciser of the present invention.
Figure 2:
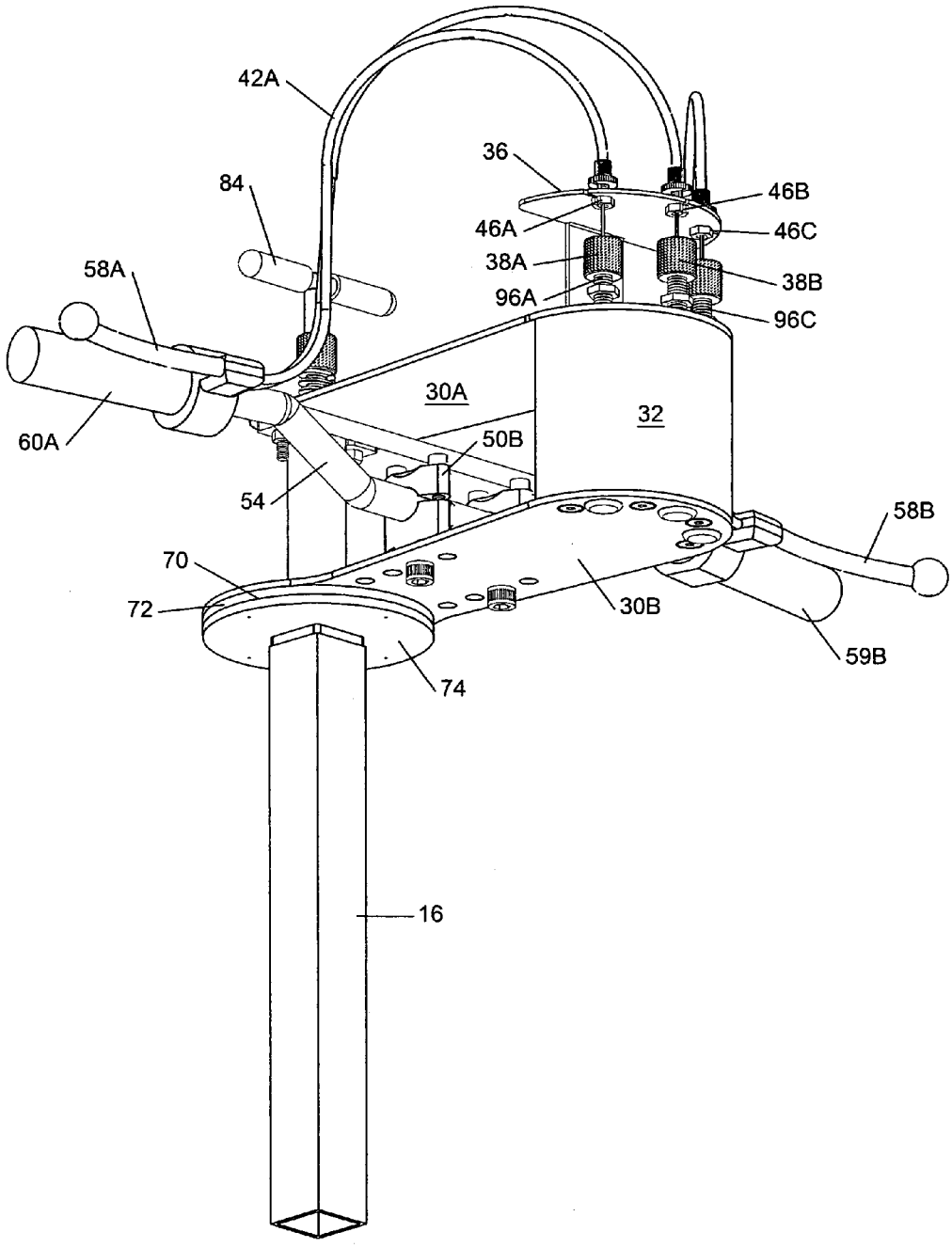
FIG. 2 is a bottom left front perspective view of the motocross exerciser of the present invention.
Figure 3:
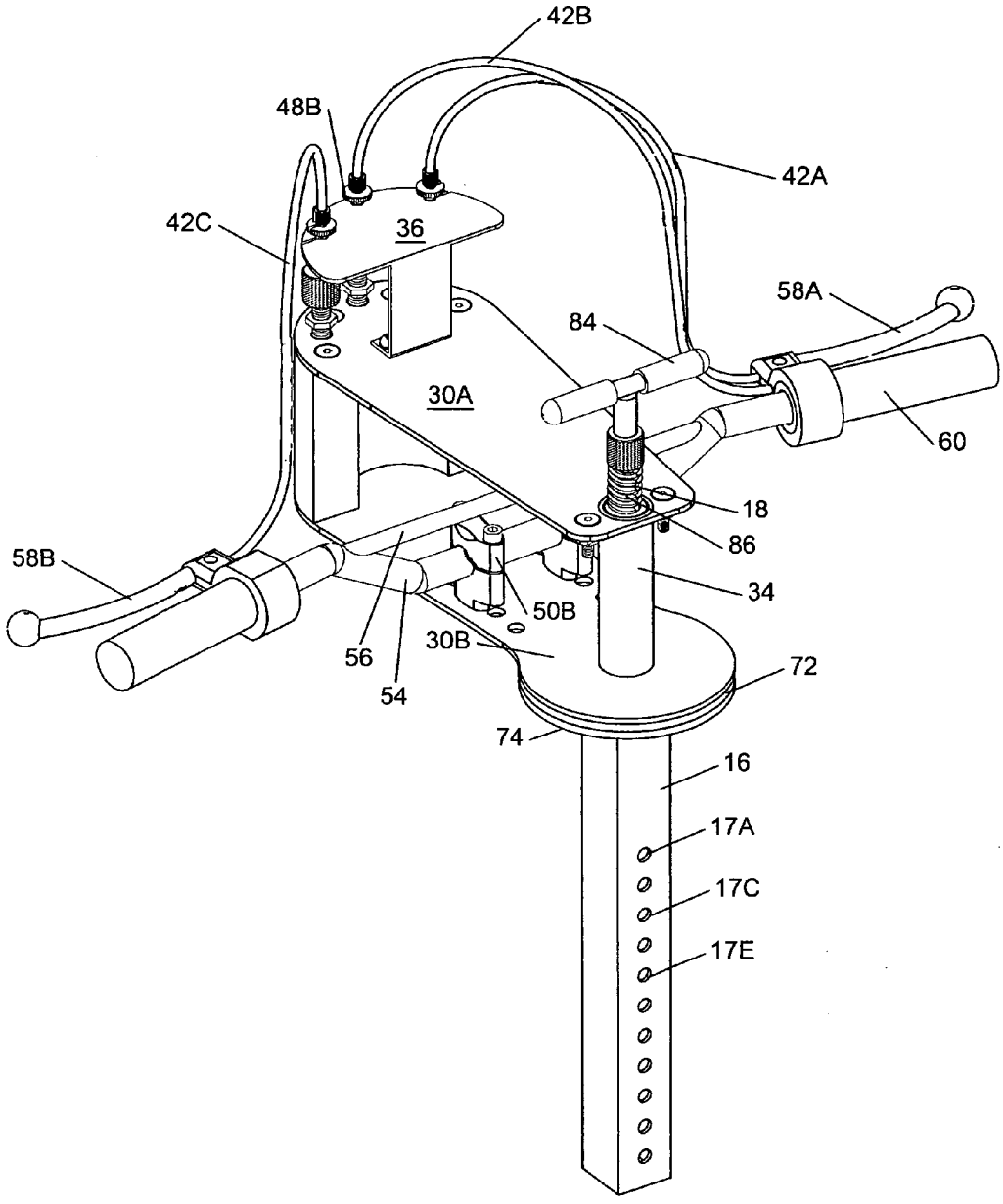
FIG. 3 is a top right back perspective view of the motocross exerciser of the present invention.
Figure 4:
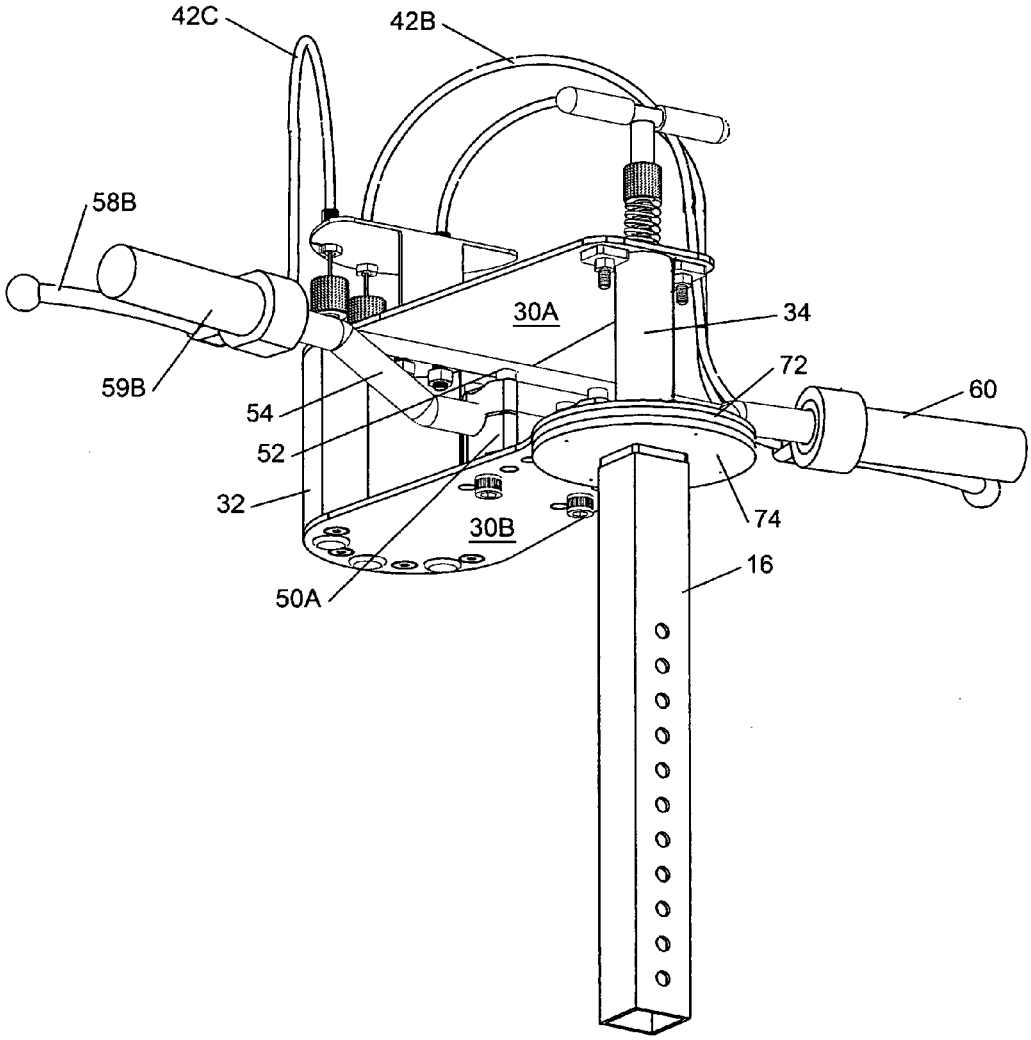
FIG. 4 is a bottom right back perspective view of the motocross exerciser of the present invention.
Figure 5:
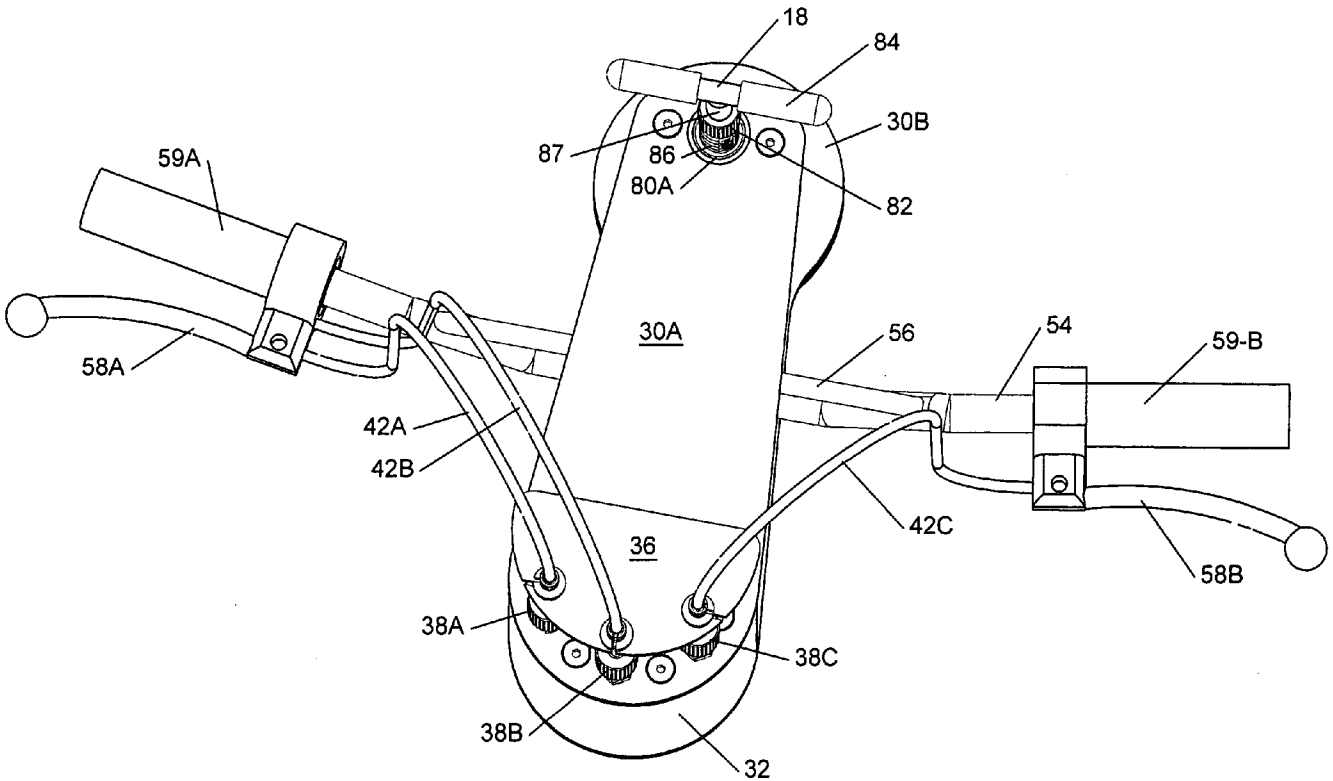
FIG. 5 is a front top perspective view of the motocross exerciser of the present invention.

Referring to FIGS. 1–4, the motocross exerciser 10 of the present invention comprises a frame 12, a handlebar assembly 14, and a support 16. The frame comprises a top plate 30A, a bottom plate 30B, which secure front housing 32 and rear housing 34 in a spaced apart relationship. A cable linkage support 36 is secured to the top of the top plate 30A to receive the ends of the cable conduits 42A, 42B, and 42C. The ends of the cable conduits are secured to the support 36 by conduit nuts 46A, 46B and 46C and conduit locking nuts 48A, 48B, and 48C. Cables 44 extend out of the ends of the cable conduits 42 and enter central bores of tensioning knobs 38A, 38B and 38C. Tensioning knobs 38 are threadingly received in front housing 32 and will be described in more detail hereinafter. The other ends (not shown) of the cable conduit 42 are connected to the brake lever 58A, the clutch lever 58B, and to rotatable throttle handle 60 in the conventional manner for motocross bikes.

The handlebar assembly 14 is secured to the frame by handlebar supports 50 which are divided into a lower part 50A and upper part 50B. The two parts are screwed together with machine screws 52. The screws can loosened to loosen the upper part 59B from the lower part 50A to permit the handlebar assembly to either be removed or installed or to be rotated fore or aft with respect to the frame.

The handlebar assembly 14 comprises the handlebar 54 which is braced with a handlebar brace 56. At the end of the handlebar are the handles 59A and 59B. Handle 59A also functions as a throttle control and is rotatable. Handle 59B is fixed and cannot be rotated. Brake lever 58A and clutch lever 58B are on opposite ends of the handlebar. Brake lever 58A and clutch lever 58B can be depressed toward the handles 59A and 59B, respectively, to simulate braking and clutch action on the motocross bike. Clutch action is disengagement of the clutch for shifting. When the brake lever is depressed to simulate braking action and the clutch handle is depressed to simulate clutch action, the cables connecting the brake lever and clutch lever to the tensioning devices within the front housing 32 (described below) place tension on the cables 44. The tensioning device biases the brake handle 58A and the clutch handle 58B to an extended brake off position and to an extended clutch engagement position. This tensioning force is adjustable so that the exerciser can build up hand strength to prevent fatigue during a motocross ride or race. Similarly, throttle control handle 60 which comprises handle 59A, which is rotatable like a throttle handle on a motocross bike, is connected by cable 44 via cable conduit 42B to the tensioning device in the front housing 32. The tensioning device via the cable returns or biases the throttle to the idle position. The tensioning force of each tensioning device is adjustable. During the exercise, the individual exercising will rotate the throttle handle which will apply a force which emulates the throttle during a motocross ride or race. Movement of the brake lever, clutch lever, and the throttle during a typical motocross race will occur several thousand times which can be extremely fatiguing to the operator unless they are well conditioned for such activity. The motocross exerciser permits a motocross rider to exercise and increase their hand strength, wrist strength, and lower arm strength so that they do not become fatigued during a motocross race or ride from the constant braking, shifting, and throttle control of the motocross bike.

The bottom plate 30B of the frame together with a friction plate assembly 70 mounted on the top of the support 16 function as a torque brake or torque resistant member. The friction plate assembly 70 comprises a friction plate 72 secured to a support plate 74. The top of friction plate 72 interacts with bottom plate 30B.

Figure 6:
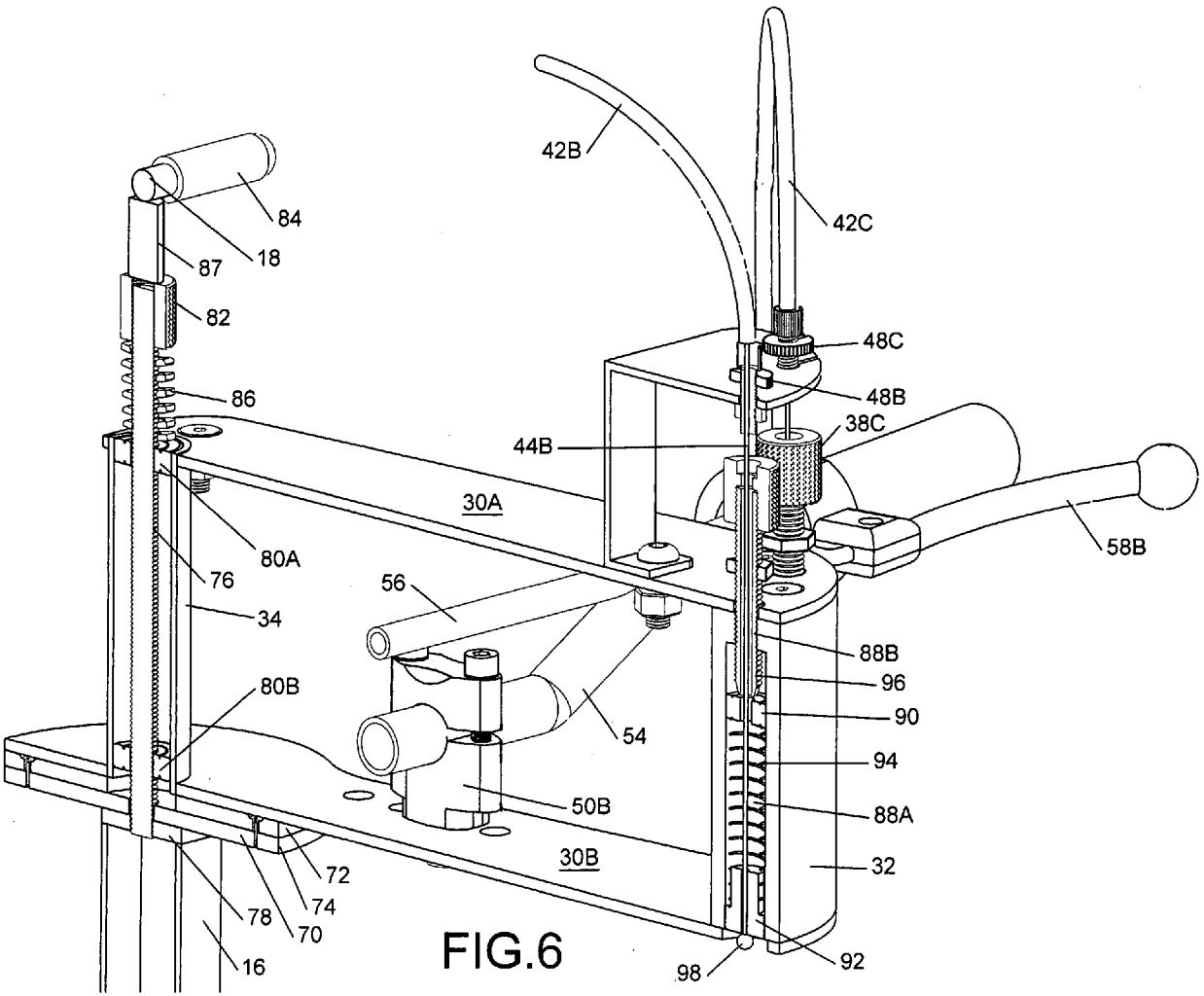
FIG. 6 is a top left front cross sectional perspective view of the motocross exerciser of the present invention.

Referring to FIG. 6, the top of support 16 has a threaded receiver 78 secured thereto. The rear housing 34 of the frame has a top bushing 80A and a top busing 80B which are coaxial with the threaded bore of threaded receiver 78. A threaded shaft 76 having a handle 84 with a sleeve 82 having a threaded bore at its top end is received through the central bores of bushings 80A and 80B. The bottom of the threaded shaft is secured in the threaded receiver 78. A compression spring 86 positioned between the top of bushing 80A and the bottom of sleeve 82 biases the frame 12 against the friction plate assembly 70. By screwing down the handle on the shaft 76, the compression spring is further compressed applying more force between bottom plate 30B and the top of friction plate 72. By applying more pressure via the threaded shaft 76, the handle 84 and the compression spring 86, the friction between the bottom plate 30B and the friction plate assembly 70 is increased requiring more force to rotate the frame 12 on its vertical axis with respect to the support 16. This simulates the forces required to turn the wheel of a motocross during a motocross race or ride. This feature of the exerciser increases lower and upper arm, shoulder, upper back and lower back strength.

The tensioning mechanism for the cables 44 for the brake and clutch handles and the throttle is illustrated in FIG. 6. The front housing 32 has three bores 88A opened at the bottom end and opened at the top end with a reduced threaded bore 88B. Bore 88A is adapted to receive a stop 90, slide 92 and a compression spring 94 positioned between the stop and slide. The position of the stop 90 is controlled by tension knob 38 which has a longitudinal threaded shaft 96 which is received by the reduced diameter threaded bore 88B. The cable 44 extends through the tensioning screw knob 96 through a central bore down through the bore of stop 90 through the central bore of the slide 92 and extends outward where it is capped off with a terminator 98 secured to the end of cable 44. The terminator prevents the cable from being drawn up through the central bore of the slide 92. When a brake lever or clutch lever is depressed to emulate a braking or shifting action, or the throttle is rotated to emulate applying power to the throttle, the cable 44 is drawn out of the tensioning device or mechanism and draws or pulls up the slide 92 which compresses the compression spring 94 further. Compression spring is compressed against stop 90 as well as slide 92. Tension screw knob 96, or the end of the treaded shaft thereof, fixes the position of the stop 90 within bore 88A and with respect to slide 90. By moving stop 90 down the bore, the spring 94 is further compressed applying more force to slide 92 which applies more force to cable 44 which in turn further biases the brake levers open to a brake off position or the throttle 60 to an idle position. The brake lever, the clutch lever, and the throttle have separate cables in separate cable conduits 44A, 44C, and 44B, respectively.

Figure 7:
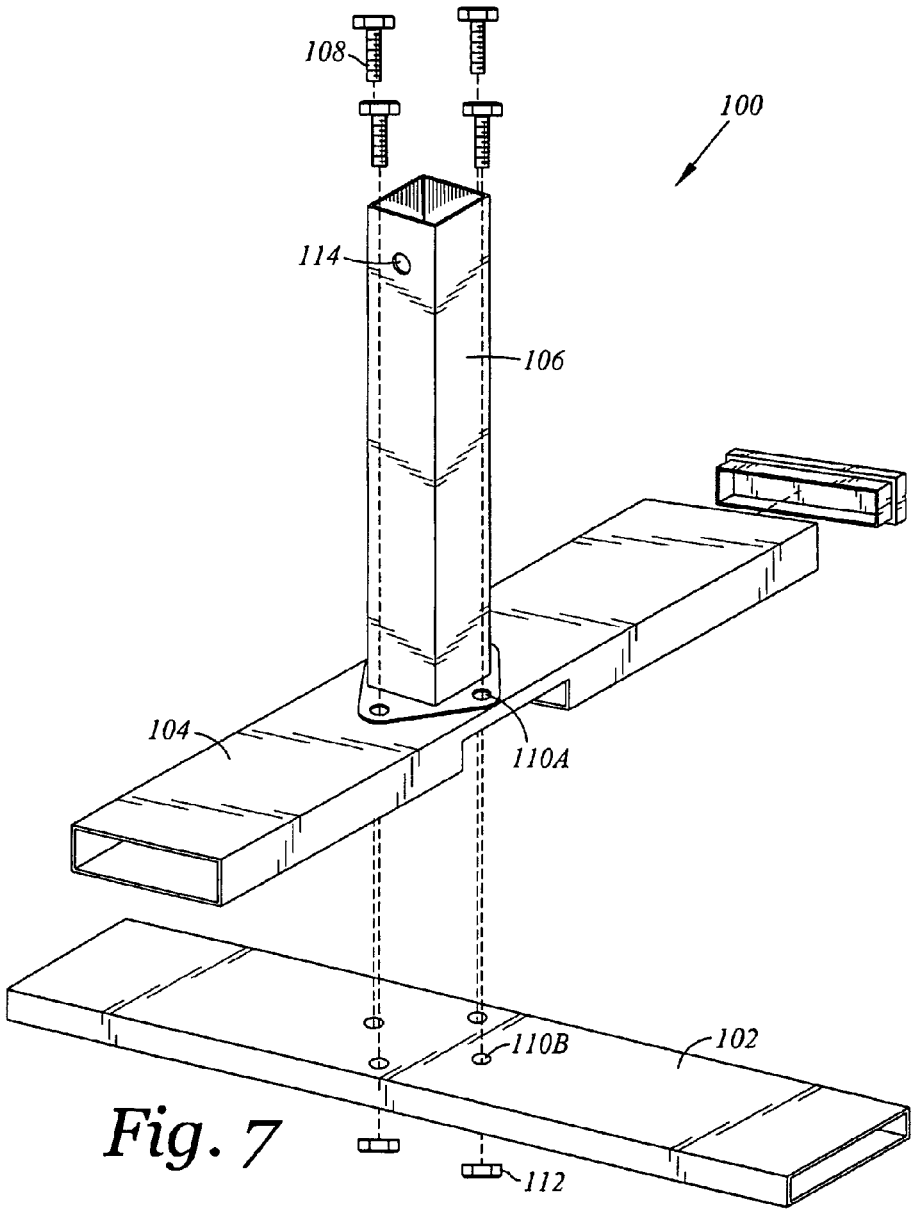
FIG. 7 is a top perspective view of a base for the motocross exerciser of the present invention.

The present device can fit onto many existing exercise benches or it can be mounted on its own stand, such as a stand or base 100 illustrated in FIG. 7. The support 16 is received within pedestal 106. The pedestal 106 has an aperture 114 which is lined up with one of the apertures 17 on the column 16. A pin (not shown) is received through hole 114 and one of the apertures 17 to lock the support or column 16 into the hollow pedestal 106. By moving the pin out and moving the support up and down with respect to the pedestal, the height of the motocross exerciser with respect the base can be adjusted for the comfort and convenience of the one exercising. The exerciser support stand is supported by cross members 102 and 104. The hollow pedestal and the two cross members are secured together by four bolts 108 passes through bolt holes 110A and 110B. The bolts are secured with four nuts 112.

Although the above invention has been described with respect to particular embodiments, it is the intent of the applicant to cover the spirit of the invention including all equivalent embodiments thereof.

I claim:

1. A motocross exerciser comprising:

a frame having a front housing, a back housing, and top and bottom plates securing the front housing to the back housing in a spaced apart relationship;

a handlebar assembly secured to the frame;

a support having a vertical axis and supported by a base, the support supporting the frame for rotation about the vertical axis;

the handlebar assembly having handles with brake lever and a clutch lever wherein one handle has a rotatable grip emulating a throttle handle, the brake lever squeezable from an extended brake Off position to a depressed brake On position, the clutch lever squeezable from an extended clutch engaged position to a depressed clutch disengaged position, and the rotatable grip rotatable from an idle position to a full power position, the brake lever and the clutch lever each being connected to a separate adjustable tensioning means by separate cable linkages, the rotatable grip connected to a separate adjustable tensioning means by a separate cable linkage, such that the respective tensioning means bias the brake lever to an extended brake Off position, the clutch lever to an extended clutch disengaged position, and the rotatable grip to the idle position; and the support in conjunction with the frame having adjustable friction means such that a user is required to provide a changeable force to rotate the frame about the vertical axis; wherein each tensioning means comprise a slide detachably secured to one end of the cable linkage, an adjustable stop through which the cable linkage can freely move and a compression spring positioned between the slide and the adjustable stop to bias the slide away from the adjustable stop.

2. The motocross exerciser according to claim 1 wherein the handlebar assembly is detachably secured to the frame.

3. The motocross exerciser according to claim 2 wherein the handlebar assembly can be partially rotated along an axis perpendicular to the vertical axis.

4. The motocross exerciser according to claim 1 wherein the slide, stop, and compression spring of tensioning means is positioned in a bore in the front housing.

5. The motocross exerciser according to claim 4 wherein the position of the stop with respect to the slide is adjustable.

6. The motocross exerciser according to claim 4 further comprises a means for positioning the stop wherein the means includes a threaded tensioning screw having a longitudinal central bore for receiving a cable linkage, and the screw is threadingly engaged with the front housing coaxially with the bore in the front housing such that an end of the screw engages and moves the stop within the central bore while the cable linkage passes freely through the central bore.

7. The motocross exerciser according to claim 1 wherein the adjustable friction means comprises a first plate secured to the top of the support and positioned against a portion of the bottom plate of the frame, a shaft freely extending through the back housing and the top and bottom plates and secured to the support, the top of the shaft receiving a handle with a sleeve in thread relationship, the handle threadingly moveable up and down the top portion of the shaft, shaft and a compression spring disposed coaxially to the shaft and positioned between the top of the back housing and the sleeve, such that the compression spring bias the frame against the first plate and away from the sleeve.

8. The motocross exerciser according to claim 1 wherein the support is slidingly received by the base.

9. The motocross exerciser according to claim 1 wherein the support can be detachably secured in the base.

10. The motocross exerciser according to claim 1 wherein the base has a hollow pillar that receives the support within the pillar for slidable engagement.

* * * * *